US007029555B2

(12) United States Patent
Yamanaka et al.

(10) Patent No.: US 7,029,555 B2
(45) Date of Patent: Apr. 18, 2006

(54) DIAGONALLY JOINED CYLINDRICAL FABRIC AND MANUFACTURING METHOD THEREOF

(75) Inventors: Hiroshi Yamanaka, Tokyo (JP); Tatsuya Fujimura, Tokyo (JP)

(73) Assignee: Nippon Filcon Co., Ltd., Tokyo (JP)

( * ) Notice: Subject to any disclaimer, the term of this patent is extended or adjusted under 35 U.S.C. 154(b) by 61 days.

(21) Appl. No.: 10/704,709

(22) Filed: Nov. 12, 2003

(65) Prior Publication Data

US 2005/0019521 A1 Jan. 27, 2005

(30) Foreign Application Priority Data

Jun. 11, 2003 (JP) ..... 2003-166230

(51) Int. Cl.

| | |
|---|---|
| ***D21F 1/16*** | (2006.01) |
| ***D21F 1/46*** | (2006.01) |
| ***D21F 1/60*** | (2006.01) |
| ***D03D 3/02*** | (2006.01) |

(52) U.S. Cl. ..... 162/314; 162/357; 162/903; 162/904; 210/402; 210/499; 428/58; 28/142; 139/383 AA

(58) Field of Classification Search ..... 162/116, 162/117, 306, 348, 358.2, 358.4, 900–904, 162/361, 362, 312–314, 357; 28/110, 142; 245/10; 139/383 A, 383 AA, 425 A; 34/111, 34/116, 123, 95; 210/402, 499; 428/58
See application file for complete search history.

(56) References Cited

U.S. PATENT DOCUMENTS

| | | | | |
|---|---|---|---|---|
| 1,615,517 | A * | 1/1927 | Mundorf | 442/203 |
| 2,117,222 | A | 5/1938 | Sinclair | |
| 2,778,169 | A * | 1/1957 | Ball | 451/531 |
| 3,133,855 | A * | 5/1964 | Carpenter | 162/135 |
| 3,478,991 | A * | 11/1969 | Schiel et al. | 245/10 |
| 3,747,770 | A * | 7/1973 | Zentis | 210/402 |
| 3,900,659 | A * | 8/1975 | MacBean | 428/223 |
| 4,426,795 | A * | 1/1984 | Rudt | 34/116 |
| 4,972,561 | A * | 11/1990 | Aldrich | 28/142 |
| 5,100,512 | A * | 3/1992 | Waters | 162/110 |
| 5,431,993 | A * | 7/1995 | Metzler | 428/107 |
| 6,658,709 | B1 * | 12/2003 | Perala et al. | 28/142 |

FOREIGN PATENT DOCUMENTS

JP 45-17363 B1 6/1970

OTHER PUBLICATIONS

European Search Report dated Sep. 14, 2004.

* cited by examiner

*Primary Examiner*—Eric Hug
(74) *Attorney, Agent, or Firm*—Rader, Fishman & Grauer PLLC

(57) ABSTRACT

A diagonally joined cylindrical fabric in the form of a cylindrical endless fabric is obtained by shifting ends of facing wefts of a non-endless fabric leftward or rightward and joining together the ends of the wefts to thereby form a joining portion inclined relative to an axis of a cylinder. The cylindrical fabric comprises a weave pattern in which warp passes over continuous two or more wefts, then passes under a less number of wefts, the joining portion at ends of the fabric formed into an endless cylindrical shape is inclined relative to the axis at 25° to 5°. The surface of the cylindrical fabric is formed with crimps that are longer in a face length direction than in a circumferential direction.

8 Claims, 5 Drawing Sheets

DIAGONALLY JOINED CYLINDRICAL FABRIC AND MANUFACTURING METHOD THEREOF

DETAILED DESCRIPTION OF THE INVENTION

TECHNICAL FIELD OF THE INVENTION

The present invention relates to a cylindrical fabric and, in particular, relates to a cylindrical paper-manufacturing fabric such as a cover fabric for a cylinder, a dandy roll, a paper-manufacturing cylinder mold, or a dehydrating filter cloth.

BACKGROUND OF THE INVENTION

Conventionally, fabrics woven by the warp and weft have been widely used for cylindrical fabrics and, particularly in the paper-manufacturing processes, have been employed for a cylinder fabric of a cylinder machine, a dandy roll, a paper-manufacturing cylinder mold, a dehydrating filter cloth, and the like. In the field of paper manufacturing, it has been one of objects to improve the texture pattern or the quality of paper upon making paper. A cylindrical fabric is used by being mounted on or covering a cylindrical machine casing in a tightened state and, in the paper-manufacturing processes, is required to have an excellent surface property so as not to transfer mesh marks, joint marks, or the like of the fabric onto paper, to improve the yield of paper manufacturing, to be excellent in water filtering property, fiber supportability, wear and abrasion resistance, dimensional stability, and running stability, to be easily mounted, and so forth.

By explaining cylindrical fabrics for use in paper manufacturing wherein the requirements are strict among those to cylindrical endless fabrics as described above, it is possible to understand most requirements to the cylindrical fabrics and solutions thereof. Therefore, the present invention will be described hereinbelow taking the cylindrical fabrics for paper making as an example.

As cylindrical fabrics called cylinder molds, there are available fabrics made of plastics and fabrics made of metal. The cylindrical fabric is used by being mounted on or covering a cylindrical machine casing in an adhering state. For mounting the plastic fabric, such a method has been often used wherein a fabric formed into a cylindrical shape in advance by a known joining method is placed on an object cylinder so as to cover it, then adhered to the cylinder by thermosetting with steam or the like. Therefore, yarns forming the fabric are made of a material having a relatively high heat contraction coefficient. On the other hand, in case of the metal fabric, such a method has been mainly used wherein a non-endless fabric is cut into a parallelogram having parallel opposite sides and crossing angles of the sides being other than a right angle, and the two opposite sides are butted to each other and joined together to thereby form the fabric into a cylindrical shape. As prior art, Japanese Examined Patent Publication No. S45-17363 (1970) (hereinafter referred to as "JP-B-S45-17363") describes that one angle of a parallelogram is set to 25° to 65°, particularly 45°. When the fabric is joined according to such a method, a joining portion is inclined relative to an axis of the cylinder or the cylindrical fabric, and therefore, the fabric can be mounted in an adhering state by tightening it in the axial direction of the cylinder or the cylindrical fabric. There is also a merit that transfer of joint marks onto paper is relaxed by inclining the joining portion.

As shown in the drawings of JP-B-S45-17363, the plain weave pattern is popular among weave patterns. With respect to the plain weave pattern, there has been a drawback that although the number of intersecting points between the warp and weft is large, inasmuch as meshes of a fabric are oblique, fibers extending in the warp direction are liable to come off the meshes so that sufficient fiber supportability can not be obtained. Further, there has also been a problem that if the number of yarns is increased for improving the fiber supportability, ventilation is degraded to thereby lower a dehydrating capability. Moreover, if the joining portion is inclined at 25° or more relative to the axis as in the prior art, joint marks of the joining portion become more inconspicuous, however, an acute angle of a parallelogram for forming a cylindrical fabric becomes small and, following it, a net having a large area is required, portions to be discarded increase, and a length of the joining portion is prolonged. Therefore, there has been a problem in terms of cost, labor, and the discarding amount.

SUMMARY OF THE INVENTION

It is an object of the present invention to provide a diagonally joined cylindrical fabric that can improve a surface property, yield of paper manufacturing, a water filtering property, fiber supportability, dimensional stability, and running stability, that is facilitated in joining, and that can achieve cost reduction by reducing labor and a discarding amount, and further provide a manufacturing method thereof, with respect to, particularly, a cylindrical fabric that is employed for a cylinder fabric of a cylinder machine, a dandy roll, a paper-manufacturing cylinder mold, a dehydrating filter cloth, or the like used in the paper-manufacturing processes.

The present invention relates to a diagonally joined cylindrical fabric obtained by shifting leftward or rightward facing weft yarns or wefts at a butting portion of a cylindrical fabric formed by butting both ends of a non-endless fabric to each other, and by forming a joining portion inclined relative to an imaginary center axis of a cylinder formed by the cylindrical fabric on a surface of a formed cylindrical endless fabric. The diagonally joined cylindrical fabric may have a weave pattern having a repeating unit in which a warp passes over continuous two or more wefts, then passes under a less number of wefts. An inclination of the joining portion of the cylindrical fabric may be 25° to 5° relative to the center axis, and the surface of the cylindrical endless fabric may be formed with crimps that are longer in a face length direction than in a circumferential direction.

The inclination of the joining portion of the cylindrical fabric may be 20° to 10° relative to the center axis.

The weave pattern of the diagonally joined cylindrical fabric may be a satin weave pattern, in which a warp passes over continuous three wefts, then passes under one weft yarn, and the surface of the cylindrically joined fabric may be formed with the crimps that are longer in the face length direction than in the circumferential direction.

The warp and weft that form the fabric may be stainless steel yarns. The wefts may be joined by welding.

The diagonally joined cylindrical fabric is formed by butting and joining together two joining sides of a parallelogram fabric that is defined by the two joining sides that form the joining portion upon forming the cylindrical fabric. One of the joining sides may be provided at an end of the fabric and may have ends of the wefts perpendicularly cut along one warp yarn. The other one of the joining sides may be provided likewise in parallel to the one of said joining sides. Further, the joining sides may be defined by two parallel circumferential sides where the warp and weft are cut obliquely and which form circumferential portions upon forming the cylindrical fabric.

DETAILED EXPLANATION OF THE INVENTION

Figure 1:
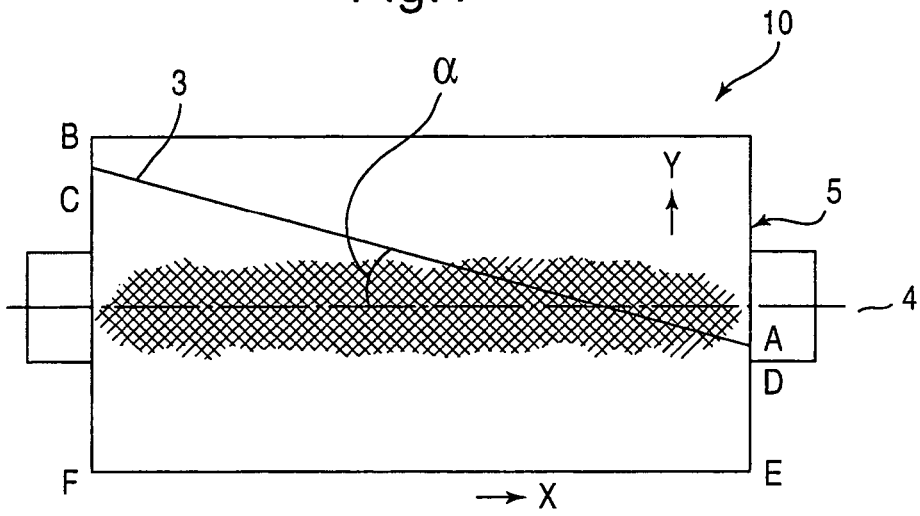
FIG. 1 shows a side view of a diagonally joined cylindrical fabric of the present invention.

A cylindrical fabric of the present invention uses an endless fabric having a weave pattern in which the warp passes over continuous two or more wefts, then passes under a less number of wefts, and is formed by shifting leftward or rightward facing wefts at a butting portion of a cylindrical fabric formed by butting both ends of a fabric to each other, and joining the wefts to thereby form a joining portion inclined relative to an imaginary center axis of a cylindrical fabric on a surface of a formed cylindrical endless fabric, wherein an inclination of the joining portion may be 25° to 5° relative to the axis. When the endless fabric having the foregoing weave pattern is joined at the foregoing angle, the surface of the cylindrical fabric takes a structure wherein more yarns are arranged in a face length direction than in a circumferential direction.

A diagonally joining angle of a cylindrical fabric that has been conventionally used is 25° to 60°, and a weave pattern of the fabric is plain weave.

An advantageous effect achieved by employing the diagonal joining is such that, by butting obliquely and tightening in the axial direction of a cylinder, the fabric can be tightly mounted on the cylinder or the like in an adhering state, and further, by inclining the joining portion, transfer of joint marks onto paper can be relaxed upon paper making. In case of the plain weave pattern, since the warp and weft are woven alternately one by one, it is excellent in rigidity as a fabric so that even if the fabric is butted obliquely and pulled in the axial direction, when the joining portion is inclined at less than 25°, the fabric is reluctant to be tightened, and therefore, unless the joining portion is inclined at 30° or more, it is difficult to tightly adhere the fabric to the cylinder. In case of the inclination of less than 5°, there is little difference from a cylindrical fabric having a joining portion inclined at 0°, and thus it becomes difficult to tightly mount the fabric on the cylinder in an adhering state. Further, joint marks of the joining portion tend to appear as compared with a case of an inclination of 5° or more, which is not preferable. Moreover, there has been a problem that when the number of yarns of a cylindrical fabric is increased in the face length direction for improving fiber supportability using a fabric having a plain weave pattern, although the fiber supportability is improved, a dehydration property is lowered.

Therefore, in the present invention, a cylindrical fabric has a weave pattern in which structural extension in a diagonal direction is greater than the plain weaving, and employs diagonal joining in which a joining portion is inclined relative to the axis of the cylindrical fabric or the cylinder at 25° to 5°. The fabric used herein has a repeating unit of the weave pattern in which the warp passes over continuous two or more wefts, then passes under a less number of wefts. Generally, when a fabric is pulled obliquely, structural extension is caused. In case of the fabric of the present invention having a less number of knuckles in a repeating unit than a fabric having a plain weave pattern, a force of constraint is small so that structural extension in an oblique direction is liable to occur. Preferably, the fabric used herein employs 3/1 broken satin weave wherein the warp passes over continuous three or more wefts, then passes under one weft. Although it is also possible to employ a weave pattern repeating unit of 4/1 or the like wherein the number of intersecting points is further reduced, since the rigidity of the fabric is lowered, it is necessary to select a suitable one taking use and the like into account. However, the present invention is not limited thereto, and it is also possible to use a 2/1 weave pattern repeating unit wherein the warp passes over continuous two wefts, then passes under one weft, a 3/2 weave pattern repeating unit, a 4/2 weave pattern repeating unit, or the like. In such a weave pattern of the fabric, more warp crimps are arranged on the surface of the fabric than weft crimps on a weaving machine. However, on the surface of the endless cylindrical fabric formed by inclining the joining portion relative to the axis of the cylindrical fabric or the cylinder at 25° to 5° and shifting wefts so as to join them, there is provided a weave pattern in which more yarns are arranged in the face length direction than in the circumferential direction, which also realizes excellent fiber supportability. Specifically, although it is the weave pattern on the weaving machine wherein long crimps of the warp passing over a plurality of continuous wefts are formed on the surface, when it is formed into the cylindrical fabric having the joining portion inclined relative to the axis at 25° to 5°, there is conversely provided a weave pattern which is formed with crimps that are longer in the face length direction than in the circumferential direction. Further, the fabric of the present invention is excellent in dehydration property and fiber supportability because, even if the number of yarns per unit area on the weave pattern is greater than that in the fabric having the plain weave pattern, since the number of knuckles between the warp and weft is small, there exists more cubic space than in the plain-weave fabric so that equivalent ventilation can be obtained. Herein, the circumferential direction represents a circumferential direction of the cylinder, and the face length direction represents a direction parallel to the imaginary center axis of the cylindrical fabric or the cylinder.

The inclined joining portion formed on the surface of the cylindrical fabric is inclined relative to the axis preferably at 25° to 5°, and more preferably at 20° to 10°. It is desirable to suitably change the joining angle depending on a fabric weave pattern and so forth. Preferably, it is 15° in the 3/1 satin fabric. In case of the 2/1 weave pattern repeating unit, it may be a greater angle, for example, 20°. Since a distance of the joining portion is shortened as the joining angle decreases, it is also preferable in terms of operability, cost, and so forth.

Preferably, in the fabric used herein, stainless steel yarns are used as the warp and weft, and joined together by a known welding method. However, instead thereof, metal yarns such as bronze yarns, or plastic yarns may be used and interwoven by a known interweaving method.

Now, a method of manufacturing the diagonally joined cylindrical fabric will be described. Generally, a diagonally joined cylindrical fabric is formed by butting and joining together two joining sides of a parallelogram fabric defined by the joining side having ends of wefts cut along one warp yarn, the other joining side parallel thereto, and two parallel circumferential sides where the warp and weft are cut obliquely, which joining and circumferential sides cross each other. The joining sides are composed of the ends of the wefts that are cut along one warp line. If the circumferential sides where the warp and weft are cut obliquely are used as joining sides, it is necessary to cause the warp and wefts cut obliquely to correspond to each other and join them together, which is difficult. It is also possible to manufacture a cylindrical fabric that is formed by butting and joining together two joining sides of a parallelogram fabric defined by the joining side having ends of warp yarns cut along one weft yarn, i.e. not one warp yarn, the other joining side parallel thereto, and two parallel circumferential sides where the warp and weft are cut obliquely, which joining and circumferential sides cross each other. However, it is preferable to join the ends of the wefts to each other in view of operability, weaving conditions, and so forth. A merit achieved by joining the ends of the wefts to each other resides in that, upon weaving a fabric by normally weaving the weft through the warp, the warp is largely bent as compared with the weft due to the structure thereof to easily form a crimp shape, and therefore, it is difficult to join together ends of the warp yarns formed with crimps, while it is easier to join ends of the wefts with less bending. Further, wefts located at an end of a fabric are more liable to come off than warp yarns at an end thereof, and therefore, upon carrying out a rubbing process of cutting yarns at both ends by half, respectively, and joining them together to form one yarn, it is not easy to cut by half the wefts that are liable to come off. Moreover, there has been a problem that since the width of a weaving machine is limited, if aiming to obtain a structure for joining ends of warp yarns to each other, the length of a fabric in the face length direction is limited by the width of the weaving machine so that it is not possible to weave a cylindrical fabric that is long in the face length direction.

Inasmuch as the length of the circumferential side of the parallelogram corresponds to the circumference of the cylindrical fabric, it may be suitably selected depending on the dimensions of the cylinder. In the butting process, ends of the same weft yarn are not butted to each other, but facing ends of the wefts are shifted by several wefts leftward or rightward following the shape of the parallelogram so as to be butted and joined together. On the other hand, it is also possible to shift ends of wefts of a rectangular fabric leftward or rightward so as to butt and join them together, and thereafter, cut the fabric into a predetermined size. However, it is preferable to cut a fabric into a parallelogram in advance in terms of operability and so forth.

EXAMPLES

Now, an embodiment of the present invention will be described using the drawings.

Example 1

FIG. 1 is a side view of a diagonally joined cylindrical fabric 10 of the present invention. A fabric formed into an endless shape was placed on a cylinder 5 so as to cover it, then both sides of the fabric were pulled outward in the face length direction X so as to be tightened, thereby mounting the fabric 10 on the cylinder 5 in an adhering state. A joining portion 3 is inclined at an angle $\alpha$ of 15° relative to an axis 4 of the cylindrical fabric 10 or the cylinder 5. The axis 4 is shown by a dot-dash line in FIG. 1, while the joining portion is shown by a thick solid line 3. The joining portion 3 is formed by wefts perpendicularly cut along one warp yarn. The both ends of the wefts are butted and joined together.

Figure 3:
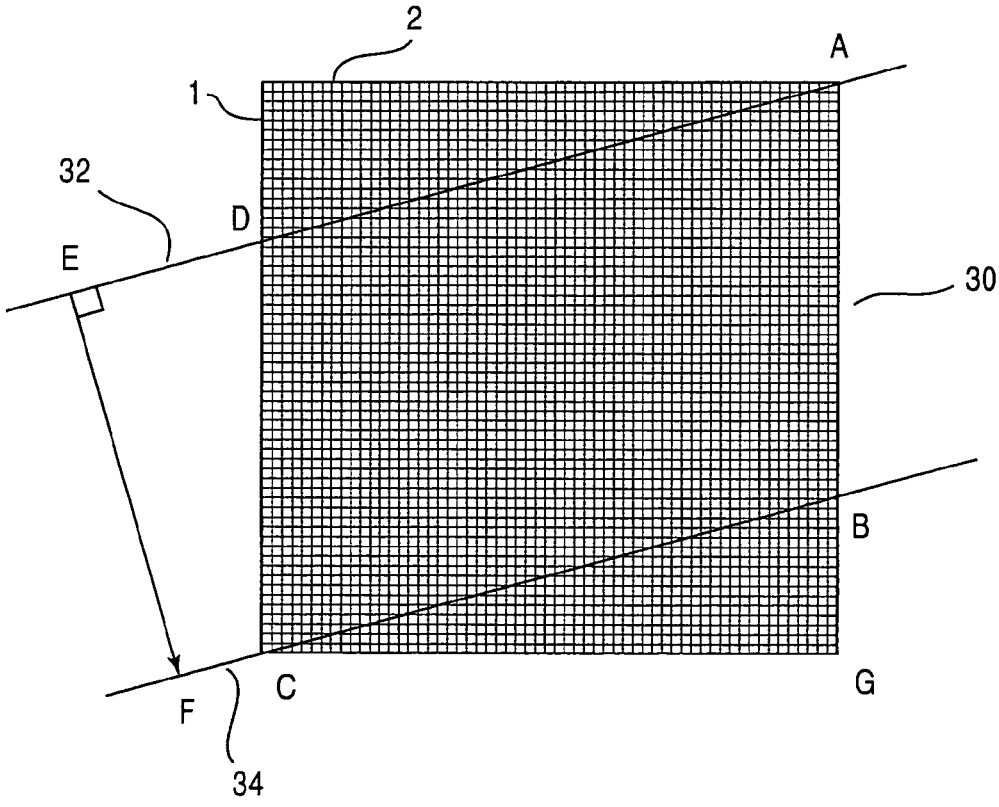
FIG. 3 shows a plan view of a fabric before cutting it into a parallelogram for producing the diagonally joined cylindrical fabric of the present invention.

For forming the cylindrical fabric 10 as shown in FIG. 1, a non-endless fabric 30 having warps 1 and wefts 2 is cut into a parallelogram as shown in FIG. 3. By cutting the fabric 30 into such a shape in advance, cutting of the fabric along the shape of the cylinder is not required after joining the fabric into the cylindrical shape.

FIG. 3 is a plan view of a fabric before cutting it into a parallelogram, wherein thick solid lines 32 and 34 represent cut portions of the fabric 30. The original fabric 30 is a rectangular fabric composed of warps 1 and wefts 2, and the wefts 2 are cut perpendicularly along the warps 1 at selvages of the fabric. A parallelogram fabric ABCD has joining sides AB and CD which are in parallel to each other, a circumferential side AD formed by obliquely cutting the warps 1 and wefts 2, and a circumferential side BC is in parallel to the circumferential side AD, wherein the joining sides AB and CD and the circumferential sides AD and BC cross each other. For inclining the joining portion at 15° from the axis, ∠BCG is set to 15°, so that ∠DCB becomes 75° and ∠ABC becomes 105°. For forming the parallelogram fabric ABCD into a cylindrical shape, the joining sides AB and DC are butted to each other and confronting ends of the wefts 2 are shifted leftward or rightward so as to join together the ends of the wefts 2, thereby forming a cylindrical fabric 10. That is, by butting point A to point D and point B to point C and joining them together, a cylindrical fabric 10 having the side AD as the circumference and a side EF as a face length is formed. In FIG. 1, by pulling the joining side AB rightward and the joining side CD leftward, meshes are deformed from rectangular to parallelogram or from square to rhombic due to an extension property of the cylindrical fabric in an oblique direction thereof, and therefore, the circumferential length of the fabric is shortened, so that the fabric can be adhered to the cylinder upon mounting the fabric thereon. Since a structure and extension of a fabric differ depending on a weave pattern of the fabric, an inclination of a joining portion, and the like, it is necessary to suitably determine dimensions of the fabric based on the weave pattern, density of the warp and weft, and so forth. Since necessary dimensions slightly change even by a joining method and the like, it is also necessary to take them into account.

With respect to the joining between the joining sides AB and DC, inasmuch as the ends of the wefts are perpendicularly cut mutually, it is sufficient to join them according to a known joining method, and therefore, there is no problem about it. On the other hand, since the warps 1 and wefts 2 are cut obliquely at the circumferential sides AD and BC, and these sides serve as end portions of the cylindrical fabric 10, it is preferable to carry out an end treatment for preventing them from catching upon making paper or handling the fabric 10.

Comparative Example 1

Figure 2:
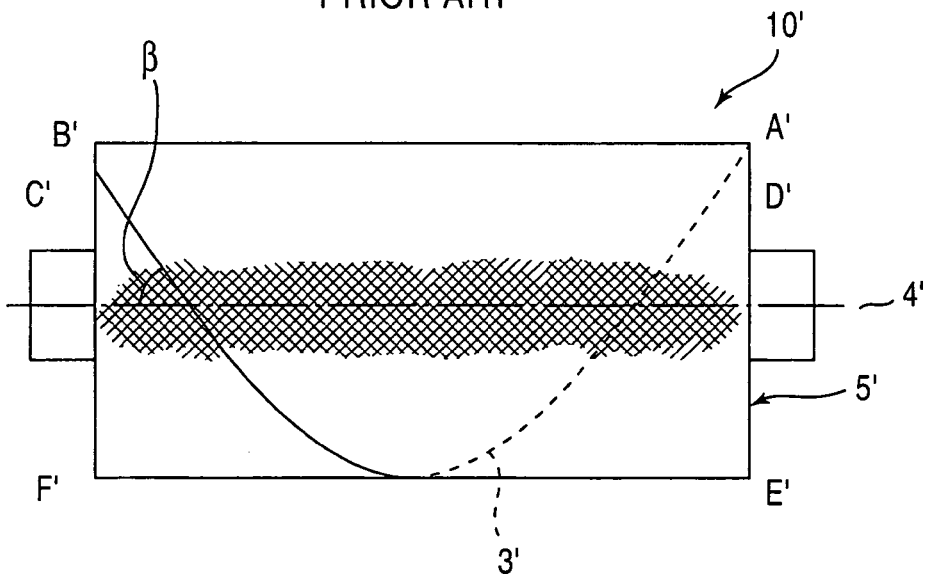
Fig.2 PRIOR ART
FIG. 2 shows a side view of a conventional diagonally joined cylindrical fabric.
Figure 4:
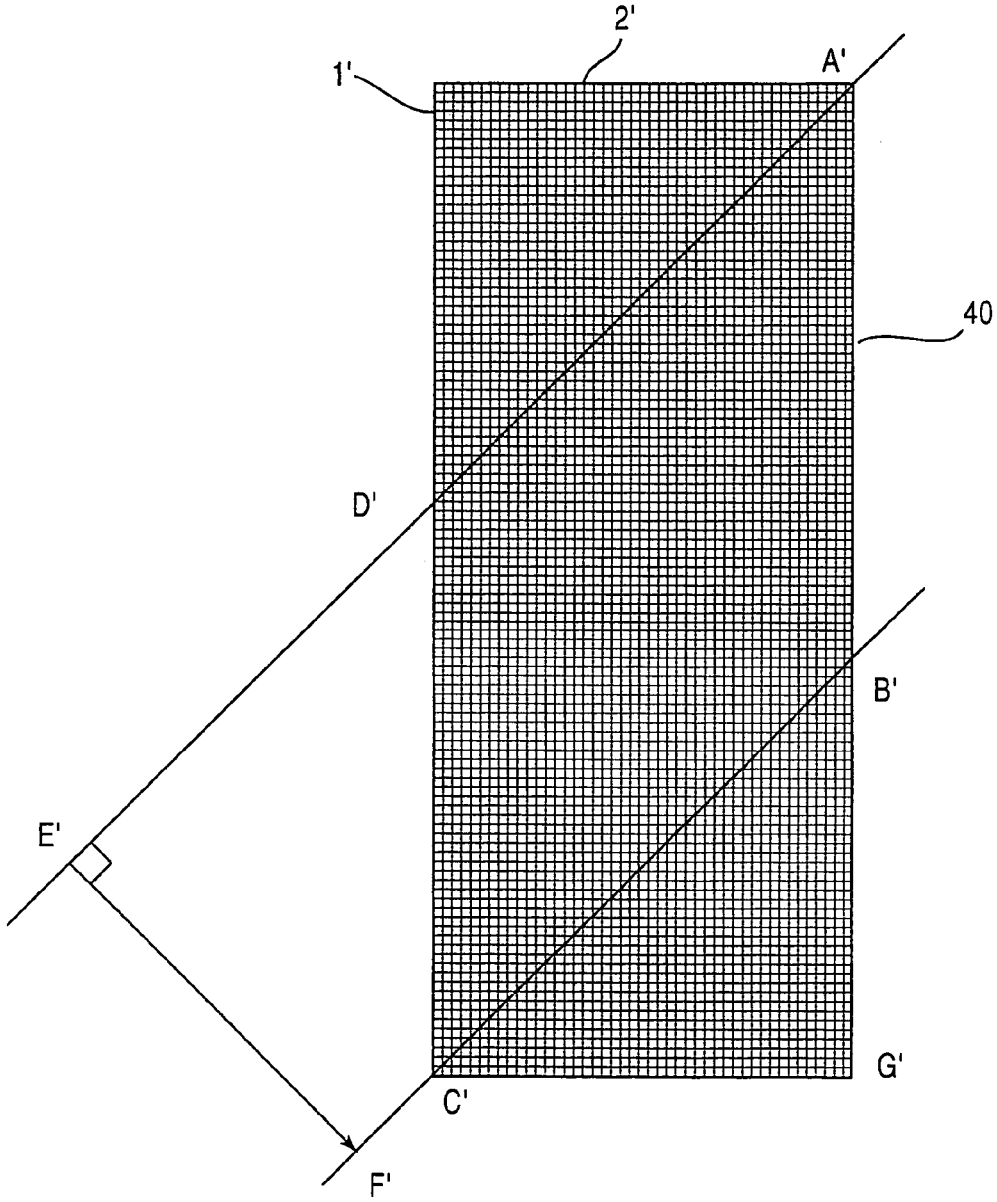
Fig.4 PRIOR ART
FIG. 4 shows a plan view of a fabric before cutting it into a parallelogram for producing the conventional diagonally joined cylindrical fabric.

FIG. 2 is a side view of a conventional cylindrical fabric wherein a joining portion of the fabric has an inclination angle β of 45° relative to the axis 4'. FIG. 4 is a plan view of a fabric 40, composed of warps 1' and wefts 2', before cutting it into a parallelogram for forming the conventional cylindrical fabric 10'. The dimensions such as the circumferences and the face lengths of the cylindrical fabrics shown in FIGS. 1 and 2, respectively, were set equal to each other. As clear from comparison between FIGS. 3 and 4, when the angle from the axis after formed into the cylindrical shape is increased from 15° to 45°, an area of the fabric 40 necessary for producing the cylindrical fabric is enlarged and, following it, a discarding area is also increased. In FIGS. 3 and 4, since the dimensions of the two cylindrical fabrics 10 in FIG. 1 and 10' in FIG. 2 are equal to each other, the lengths of the circumferential sides AD and A'D', which become the circumferences, and the lengths of the sides EF and E'F', which become the face lengths, are equal to each other. However, the lengths of the joining sides AB and A'B' differ from each other, and the side A'B' in FIG. 4 is longer than the side AB in FIG. 3. This is also clear from joining portions 3 and 3'in FIGS. 1 and 2, and the increase in joining distance causes increased labor and time for welding.

It is understood from the foregoing that when the inclination from the axis is increased, the area of the fabric necessary for forming the cylindrical fabric is enlarged and, following it, the discarding amount of the fabric is also increased, and further, since the joining length is prolonged, the labor and time for welding are also increased.

Figure 5A:
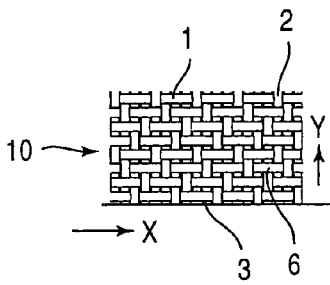
FIGS. 5A, 5B and 5C show enlarged diagrams of the fabric surfaces when a fabric having a weave pattern of the present invention is inclined relative to an axis of a cylinder at 0°, 15°, and 45°, respectively.
Figure 5B:
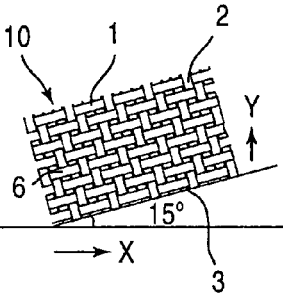
Figure 5C:
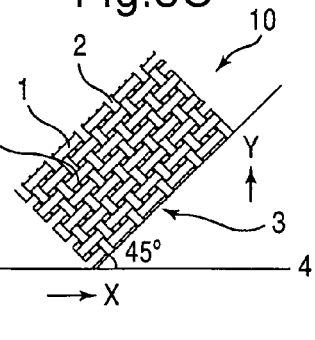

FIGS. 5A through 5C and 6A through 6C are enlarged diagrams of the surfaces of fabrics shown in FIGS. 1 and 2 respectively, when the fabrics are inclined relative to the axis 4. FIGS. 5A through 5C show a fabric 10 having a weave pattern corresponding to the present invention, wherein the warp 1 on a weaving machine passes over continuous three or more wefts 2, then passes under one weft 2. The weave pattern of the diagonally joined cylindrical fabric 10 is a satin weave pattern, in which a warp 1 passes over continuous three wefts 2, then passes under one weft yarn 2, and the surface of the cylindrically joined fabric 10 may be formed with the crimps 6 that are longer in the face length direction X than in the circumferential direction Y.

Figure 6A:
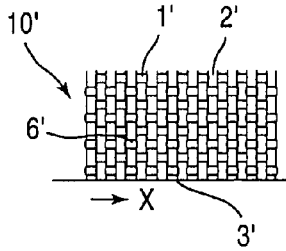
Fig.6A PRIOR ART
FIGS. 6A, 6B and 6C show enlarged diagrams of the fabric surfaces when a fabric having a conventional weave pattern is inclined relative to an axis of a cylinder at 0°, 15°, and 45°, respectively.
Figure 6B:
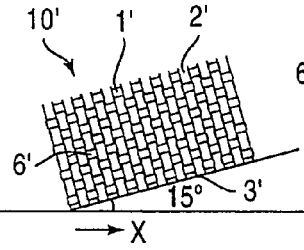
Fig.6B PRIOR ART
Figure 6C:
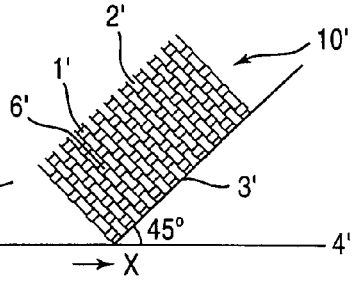
Fig.6C PRIOR ART

FIGS. 6A through 6C shows a fabric 10' having a plain weave pattern wherein the warp 1' passes alternately over and under wefts 2', which has been used for a conventional cylindrical fabric 10'. In FIGS. 5A through 5C and 6A through 6C are plan views of the fabrics 10 and 10' of FIGS. 1 and 2 respectively, wherein joining portions 3, 3' thereof respectively are inclined relative to the axis 4, 4' at 0°, 15°, and 45°, respectively.

In FIGS. 5A and 6A, the inclination of the joining portions 3 and 3' are 0°, the joining portions 3, 3' extend straight in the face length direction X, and crimps 6 shown in FIGS. 5A, 5B and 5C that are long in the face length direction X are formed on the fabric surface in FIG. 5A. The inclination of the joining portions is 15° in FIGS. 5B and 6B, and 45° in FIGS. 5C and 6C respectively. It is seen that crimps 6, 6' on the surfaces of the fabrics 10, 10' are largely inclined in FIGS. 5C and 6C.

Generally, in paper manufacturing, pulp fibers, a material of paper, are oriented in the circumferential direction. Therefore, for supporting the fibers, it is preferable to employ a weave pattern formed by crimps that are long in the face length direction crossing the fibers. That is, in view of the fiber supportability, the weave pattern in which the crimps 6, longer in the face length direction X than the crimps 6' of FIGS. 6A through 6C, are formed on the surfaces as shown in FIGS. 5A through 5C is preferable to the plain weave pattern as shown in FIGS. 6A through 6C. The fabric shown in FIG. 5C is the most preferable embodiment in terms of the fiber supportability. However, since the joining portion 3 extends straight in the face length direction X, joint marks (not shown) are liable to appear on wet paper, and further, since the fabric 10 can hardly be pulled obliquely, it is difficult to tightly mount the fabric on a cylinder or the like in an adhering state. On the other hand, in the fabric shown in FIG. 5C, since yarns are inclined relative to the fiber orientation direction, the fibers come off meshes to lower the fiber supportability, and further, since the joining length is prolonged as the joining angle increases, the required fabric area and the discarding amount are increased. The fabric 10 shown in FIG. 5C is slightly inferior in fiber supportability to the fabric 10 shown in FIG. 5A. However, since the weave pattern has the long crimps 6 extending in the weft direction on the surface, there is no excessive coming-off of the fibers so that sufficient fiber supportability is obtained. Further, the length of the joining portion is short, and the fabric can be tightly mounted on a cylinder or the like in an adhering state more easily as compared with the fabric 10' shown in FIG. 6C.

Figure 7:
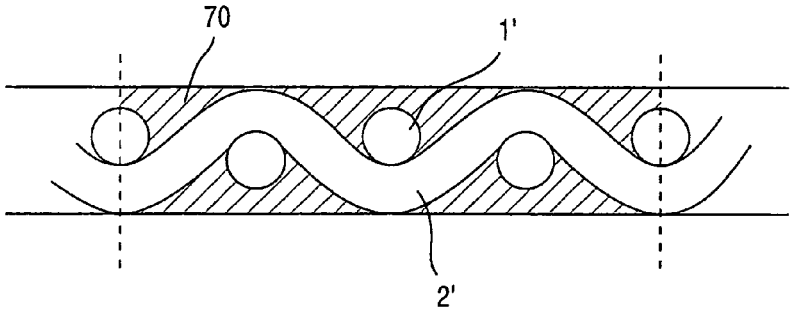
FIG. 7 shows a reference sectional view of a fabric having a plain weave pattern.
Figure 8:
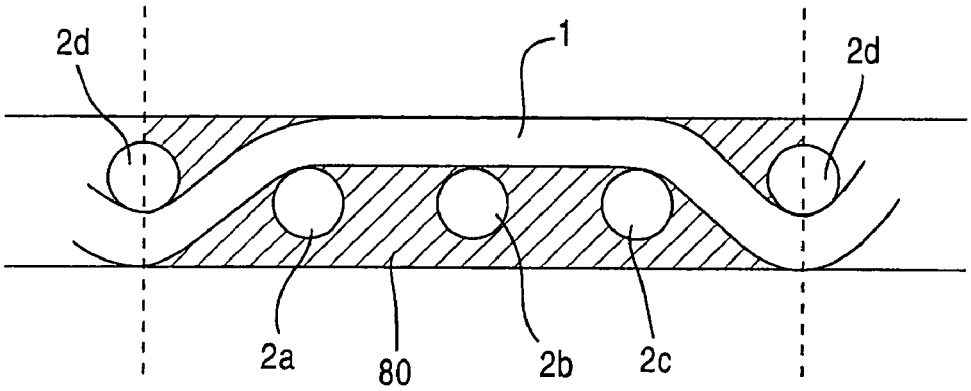
FIG. 8 shows a reference sectional view of a fabric having a twill weave pattern.

From the foregoing, a fabric excellent in fiber supportability, mark property, easiness of mounting, labor and time for the joining process, and economy can be formed by providing a cylindrical endless fabric wherein a joining portion of an endless fabric having a weave pattern in a repeating unit in which the warp passes over continuous two or more wefts, then passes under a less number of wefts is inclined relative to an axis of a cylinder at 25° to 5°. FIG. 7 is a reference sectional view of a fabric having a plain weave pattern, wherein warps 1' and wefts 2' are alternately disposed, which has been used for a conventional diagonal fabric. FIG. 8 is another reference sectional view of a twill weave pattern that is used for the present invention, wherein a warp 1 passes over continuous three wefts 2*a*, 2*b* and 2*c*, then passes under a weft 2*d*. As seen from comparison between unit cubic spaces (the shaded portions) 70 in FIG. 7 and 80 in FIG. 8 in which the same yarns in diameter and the same number of yarns are disposed, the unit cubic space 80 in FIG. 8 is larger than the unit cubic space 70 in FIG. 7. As a result, ventilation and dehydration properties tend to be higher. Further, even if the number of wefts per unit distance is increased, there can be obtained ventilation equal to that of a plain weave pattern having a less number of wefts per unit distance, so that the fiber supportability can be improved by increasing the number of wefts while ensuring the same ventilation.

Although only some exemplary embodiments of this invention have been described in detail above, those skilled in the art will readily appreciated that many modifications are possible in the exemplary embodiments without materially departing from the novel teachings and advantages of this invention. Accordingly, all such modifications are intended to be included within the scope of this invention.

The disclosure of Japanese Patent Application No. 2003-166230 filed Jun. 11, 2003 including specification, drawings and claims is incorporated herein by reference in its entirety.

What is claimed is:

1. A diagonally joined cylindrical fabric having a weave pattern with warps and wefts comprising:

a joining portion where the wefts of first and second ends of the cylindrical fabric are joined, an inclination of the joining portion is less than 25° to 5° relative to an axis of the cylindrical fabric on a surface of the cylindrical fabric;

a repeating unit of the weave pattern comprises a warp that passes over continuous two or more wefts and then passes under a less number of wefts thereby forming the surface having crimps which are longer in a face length direction than in a circumferential direction.

2. The diagonally joined cylindrical fabric according to claim 1, wherein the inclination of the joining portion is 20° to 10° relative to the axis.

3. The diagonally joined cylindrical fabric according to claim 1, wherein the weave pattern of the diagonally joined cylindrical fabric is a satin weave pattern in which the warp passes over continuous three wefts and then passes under one weft in the repeating unit.

4. The diagonally joined cylindrical fabric according to claim 1, wherein the warps and wefts are stainless steel yarns, and the wefts are joined at the joining portion by welding.

5. A method of manufacturing the diagonally joined cylindrical fabric having a weave pattern with warps and wefts, said method comprising:

butting the wefts of first and second ends of a parallelogram fabric, the wefts being perpendicularly cut along one of the warps at the first and second ends, the second end being provided in parallel to the first end, said parallelogram fabric being further defined by first and second parallel circumferential sides where the warps and wefts are cut obliquely and which form circumferential portions upon forming the cylindrical fabric; and forming a joining portion by joining the wefts of the first and second ends, the joining portion having inclination of less than 25° to 5° relative to an axis of the cylindrical fabric on a surface of the cylindrical fabric, the surface of the cylindrical fabric being formed with crimps which are longer in a face length direction than in a circumferential direction.

6. The method of manufacturing the diagonally joined cylindrical fabric according to claim 5, wherein the inclination of the joining portion is 20° to 10° relative to the axis.

7. The method of manufacturing diagonally joined cylindrical fabric according to claim 5 , wherein the weave pattern is a satin weave pattern, in which a warp passes over continuous three wefts and then passes under one weft in a repeating unit, and the surface of the cylindrically joined fabric is formed with the crimps that are longer in the face length direction than in the circumferential direction.

8. The method of manufacturing diagonally joined cylindrical fabric according to claim 5, wherein the warps and wefts are stainless steel yarns, and the wefts are joined at the joining portion by welding.

* * * * *